US007243741B2

(12) United States Patent
Swartout

(10) Patent No.: US 7,243,741 B2
(45) Date of Patent: Jul. 17, 2007

(54) SEPARATION OF EVOLVED GASES FROM DRILLING FLUIDS IN A DRILLING OPERATION

(76) Inventor: Matt Swartout, 1131 Varsity Estate Rise N.W., Calgary, Alberta (CA) T2P 0S5

( * ) Notice: Subject to any disclaimer, the term of this patent is extended or adjusted under 35 U.S.C. 154(b) by 350 days.

(21) Appl. No.: 10/990,523

(22) Filed: Nov. 18, 2004

(65) Prior Publication Data

US 2005/0269137 A1 Dec. 8, 2005

Related U.S. Application Data

(63) Continuation-in-part of application No. 10/860,097, filed on Jun. 4, 2004, now Pat. No. 7,156,193.

(51) Int. Cl.
*E21B 21/06* (2006.01)

(52) U.S. Cl. ..... 175/209; 175/212

(58) Field of Classification Search ..... None
See application file for complete search history.

(56) References Cited

U.S. PATENT DOCUMENTS 4,247,312 A 1/1981 Thakur et al.
5,814,230 A 9/1998 Willis et al.
6,059,977 A 5/2000 Rowney et al.
6,315,813 B1 11/2001 Morgan et al.
6,328,118 B1 * 12/2001 Karigan et al. ..... 175/66
6,533,946 B2 3/2003 Pullman

FOREIGN PATENT DOCUMENTS

CA 1127626 7/1982
WO WO 89/09091 10/1989

* cited by examiner

*Primary Examiner*—Zakiya W. Bates
(74) *Attorney, Agent, or Firm*—Sean W Goodwin; Linda M Thompson

(57) ABSTRACT

A fluid handling system for drilling cuttings utilizes a constant and gravity managed liquid level between a substantially atmospheric separator and a shale shaker. Substantially all of the gas entrained in the cuttings is evolved and passed to a flare for preventing evolution of the gas at the shale shaker. Solids from the separator are combined with liquid recirculation from and returning to the shale shaker. Optionally, a vacuum degasser is positioned between the separator and the shale shaker and separated gases are passed from the degasser to the flare. This method and system is particularly applicable to balanced, underbalanced and air drilling operations where the flow of gas is intermittent and unpredictable.

17 Claims, 4 Drawing Sheets

SEPARATION OF EVOLVED GASES FROM DRILLING FLUIDS IN A DRILLING OPERATION

CROSS-REFERENCE TO RELATED APPLICATION

This application is a continuation-in-part application of: U.S. patent application Ser. No. 10/860,097, filed Jun. 4, 2004, now U.S. Pat. No. 7,156,193, the entirety of which is incorporated herein by reference.

FIELD OF THE INVENTION

Embodiments of the invention relate to systems for fluid handling drilling fluids and, more particularly, to the handling of drilling fluids containing intermittent and unpredictable amounts of gaseous hydrocarbons for the prevention of gas release at surface or backflash from a flame used to burn at least a portion of combustible gases from a wellbore, either directly or following separation in a separator.

BACKGROUND OF THE INVENTION

In the drilling of oil and gas wells and in oil and gas production facilities, flare stacks and/or blooie lines are used, through which combustible gases, offgassed from the wellbore, are released and burned. The release of gas through the flare stack or blooie line is typically intermittent and has non-predictable rates, including low velocity flow, creating the potential for backflash, which is the advancing of the flame front back through the flow to the source of the gas.

During the drilling of oil and gas wells, using a variety of drilling fluids including, but not limited to air, mist, foam, aerated and liquid mud systems, the release of combustible gases is most likely to occur while drilling at balanced or underbalanced phases of well control. Air drilling operations, whether straight air, mist or foam, are particularly at risk for backflash and, particularly so, when stopping and starting the flow of air to the wellbore while making and breaking drillpipe connections. After connection and following commencement of the flow of air in the drillpipe, it takes some time before the air completes the circuit downhole and back to surface, thus leaving a lower gas velocity below the flare igniter and therefore creating the potential for backflash.

Generally, backflash is most likely to occur where there is a combination of three factors, namely; a low to zero velocity flow of a combustible air and hydrocarbon gas mixture through the flare stack or blooie line; the combustible gas mixture is contained in a finite structure within the flare stack and/or blooie line or other structure; and there is a means for igniting the combustible gas mixture. One such typical example exists in a flare stack line extending from a separator vessel or a blooie line extending from the wellhead in underbalanced or balanced drilling wherein a combustible gas mixture flows from the wellbore flow tee, diverter or rotating diverter head or the separator to the flare stack and/or blooie line having an outlet to the atmosphere, the flare stack and/or blooie line being equipped with a continuous ignition source.

As described in "Flammability and Flashback Prevention (a work in progress)" by Dan Banks, P.E posted on the worldwide web at www.banksengineering.com/about flame arrestors and detona.htm, flame progresses at a defined rate through a combustible mixture. If the flow velocity of the gas mixture through the flare stack and/or blooie line falls below a minimum gas velocity, the minimum gas velocity being a velocity greater than a flame propagation velocity, the flame is capable of moving upstream from the point of ignition to the source of the gas and igniting the gas therein. For example, in the case of a methane/air mixture, the velocity in the pipe must exceed 1.5 ft/sec to prevent flame propagation upstream to the ignition source. If the gas source of the combustible mixture is at the separator, the separator is at risk of explosion; or if the flame front of the backflash travels down into the wellbore, a downhole fire and possibly an explosion is likely, which could result in the loss of the entire well section.

Typically, conventional underbalanced separators utilize backpressure valves during balanced and underbalanced drilling operations to attempt to prevent backflash however, in some circumstances the backflash can still occur through the backpressure valve. Further, pressure maintained in the separator as a result of the backpressure valve retards entrained gas from evolving from the drilling fluids in the separator. As drilling fluids are passed to a shale shaker, entrained gas which did not evolve in the separator can evolve at the shaker, creating a fire potential or the potential for the release of carcinogenic and toxic gases. The backpressure valve may also result in the exertion of a higher bottom hole pressure on the formation which can interfere with underbalanced drilling. In the case of blooie line systems, it is typical that no backflash systems are employed. In either case, it is known in the industry that backflashes to separator vessels and into wellbores have occurred, resulting in compromise to the structural integrity of mud/gas separators and causing underground fires. In Canada, backflashes have been experienced by a number of companies, particularly while air hammer drilling and/or foam drilling.

As reported by Susan Eaton in New Technology Magazine, March 2002 "Conquering Foothills Challenges—the air force", air drilling can be dangerous, risky and costly, and underground fires are a real danger. As suggested, successes have been realized using a combination of air and nitrogen or nitrogen alone to replace combustible mixtures with air, however providing a source of compressed nitrogen suitable for use in the volumes required for air drilling is costly and requires additional specialized equipment at surface.

In cases where a large influx of fluids or gas, called a "kick", is encountered or predicted while drilling, the operator typically shuts the blowout preventer (BOP), weights up the drilling fluid and commences drilling again using a heavier drilling fluid to increase the hydrostatic head in the wellbore which is capable of suppressing or minimizing the fluid influx. Cessation of drilling and weighting up the drilling fluid results in lost drilling time and decreased rates of penetration (ROP).

Clearly what is needed is a simple, reliable system for handling drilling fluids, particularly where "kicks" may be anticipated, that permits the evolution of gases from the drilling fluids within a separator for eliminating evolution of gas at the shale shaker preventing backflash and fear of environmental contamination. Further, it is desirable that the system permit continued drilling despite the intermittent influx of combustible hydrocarbons so as to maintain high ROP's.

SUMMARY OF THE INVENTION

A liquid handling system for drilling fluids, utilizing a low pressure separator and positioned between a wellhead and a flare, employs fluid level control between the separator and a shale shaker tank for creating a stagnant zone of liquid permitting substantially all of the gas to be evolved from the liquids and solids prior to flowing the liquids and solids to the shale shaker. Thus, evolution of gas at the shale shaker is avoided. Recirculation of substantially solids-free liquid from the shale shaker tank past the solids outlet of the separator conveys the solids from the separator to the shale shaker.

In a broad aspect of the invention, the system for handling drilling fluids including drilling cuttings returned from a wellbore during drilling, the fluids further comprising an intermittent and unpredictable flow of gaseous hydrocarbons entrained therein comprises: a vertical separator for receiving drilling fluids from the wellbore further comprising: a liquid volume having a liquid level control, a stagnant zone of liquid for separating the entrained gaseous hydrocarbons from the drilling fluids; a solids outlet for discharging substantially gas free drilling solids therefrom; a liquid outlet for discharging substantially gas free liquids therefrom; and a gas outlet for discharging evolved gaseous hydrocarbons at substantially atmospheric pressure therefrom; a shale shaker for receiving substantially gas free drilling solids and substantially gas free liquids discharged from the separator and for further separating the drilling solids from the liquids; a recirculation line for flowing substantially gas free separated liquids, from the shale shaker, by the solids outlet for conducting substantially gas free liquids and solids to the shale shaker; an ignition source for receiving and combusting evolved hydrocarbons from the separator; and a flame arrestor positioned between the wellbore and the ignition source.

Preferably, the system further comprises the continuous positive backflash prevention system as set forth in co-pending U.S. application Ser. No. 10/860,097, wherein a method and system for prevention of backflash from an ignition source to a source of combustible gas utilizes a flow of addition fluid, typically air or exhaust gas, introduced into the flow of combustible gas to the ignition source in at least a minimum flame propagation velocity to ensure a continuous positive flow to the ignition source regardless the intermittent and unpredictable nature of the flow of combustible gas. Embodiments of the invention are particularly useful when drilling wellbores in balanced and underbalanced conditions and more particularly, using air/foam/aeration drilling.

In a broad aspect of the invention, a method for prevention of flashback from an ignition source towards a wellbore during drilling of the wellbore comprises injecting a drilling fluid into a wellbore; producing the drilling fluid from the wellbore for removing cuttings from the wellbore, the produced drilling fluid containing combustible gas; flowing the combustible gas to the ignition source for burning of said combustible gas; and continuously providing an addition fluid at a velocity of at least a minimal flame propagation velocity into the flowing combustible gas downstream of the wellbore and upstream of the ignition source for avoiding flashback from the ignition source.

In a further broad aspect of the invention, a system for the prevention of flashback from an ignition source connected to a wellbore producing unpredictable and intermittent flows of combustible hydrocarbons during drilling of the wellbore, comprises a source of addition fluid connected to the flow of combustible hydrocarbons between the wellbore and the ignition source; a venturi for accelerating the flow of the addition fluid into the flow of combustible gas for inducing flow of combustible gas to the ignition source; wherein the addition fluid is continuously provided to the flow of combustible hydrocarbons in a velocity in excess of a minimal flame propagation velocity to prevent backflash from the ignition source to the wellbore.

The addition fluid is typically air or exhaust gas and in an embodiment of the invention, is provided into the flow between the wellbore and the ignition source using a venturi, which acts to accelerate the flow of the addition fluid causing the combined flow to be accelerated and ensures the combustible gases flows towards the ignition source. The venturi inlet can be positioned anywhere between the wellbore and the ignition source, typically a flare stack or blooie line.

In an embodiment of the invention, the venturi is positioned between a separator and the flare stack, the separator acting to provide containment of the off-gas produced with the drilling fluids and cuttings from the wellbore and to direct the gas evolved from the drilling fluids to the flare stack. The use of the separator in combination with the positive flow achieved by the addition fluid, enables drilling to proceed regardless whether "kicks" of combustible gas come from the wellbore, eliminating the need to shut the BOP's and weight up or otherwise change the drilling fluids and reducing the fear of backflash, while at the same time providing containment of gases within the separator for evolution therein and release to the flare stack without fear of gases remaining entrained and releasing at the shale shaker. The ability to drill without altering the hydrostatic head in the wellbore permits balanced and underbalanced drilling to continue and further results in being able to maintain higher ROP's.

In the case where there is a potential for the release of sour gas from the wellbore, a vacuum degasser is introduced after the separator and discharges gas to the flare stack and liquid to the shale shaker. Liquids exiting the separator are passed to the vacuum degasser to ensure that any gas remaining in the liquid is evolved from the liquid, the evolved gas being flowed to the flare stack and the liquids and solids directed to the shale shaker.

Often drillers overlook the advantages of air drilling due to the time and costs associated with rig up and rig out of conventional air equipment implementation. A further advantage of the system of the present invention is that the system can be installed at the start of well drilling and can be used for all drilling fluid programs which might be employed, including conventional overbalanced, balanced, underbalanced and air drilling and transitions therebetween. Further, implementation of the system of the present invention minimizes drilling interruptions with changes of drilling fluids.

DETAILED DESCRIPTION OF THE PREFERRED EMBODIMENT

Figure 1:
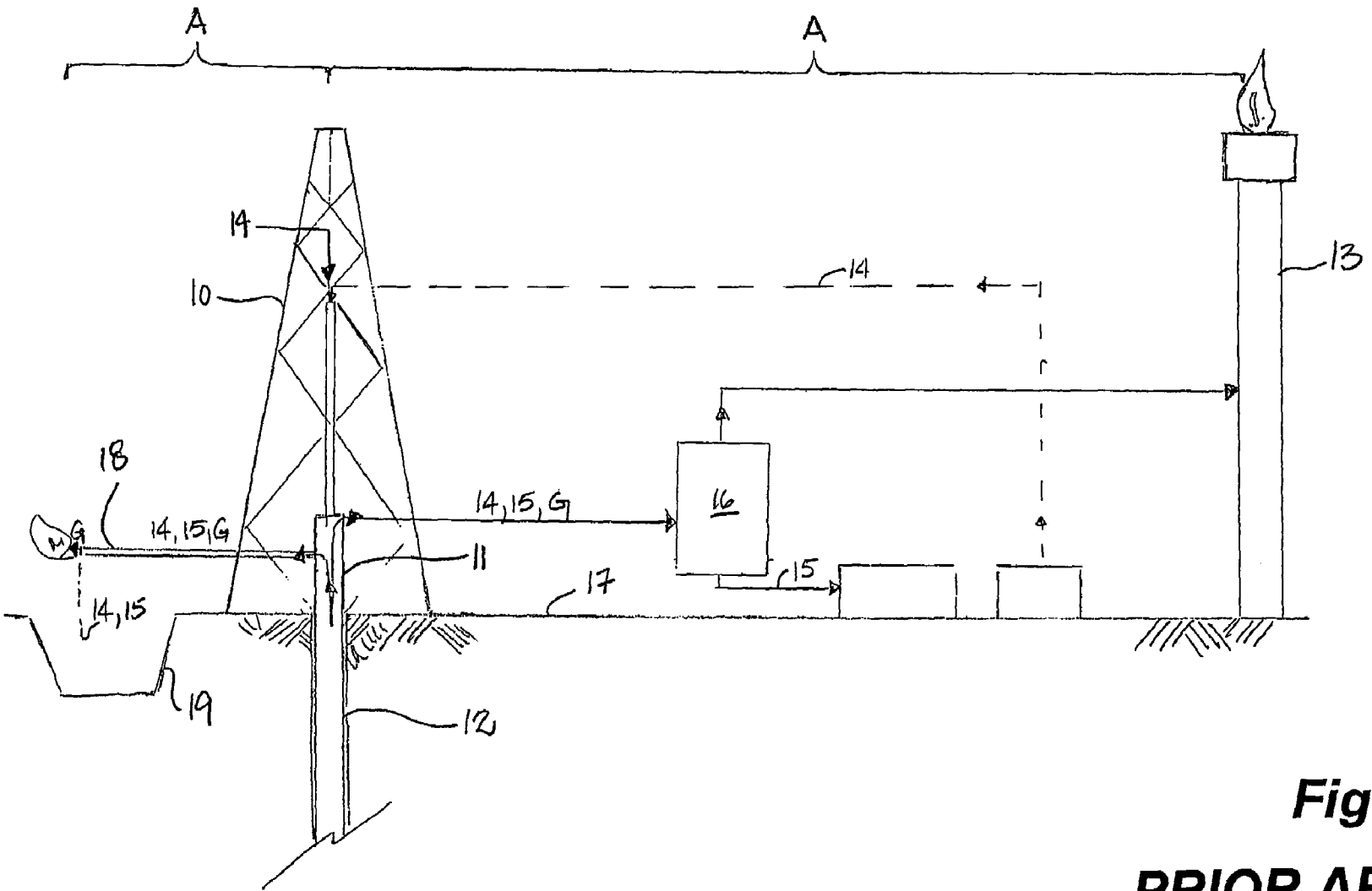
Fig. 1 PRIOR ART
FIG. 1 is a schematic of a typical mud drilling operation, being an air, mist, foam aerated mud or liquid mud drilling operation, illustrating a conventional wellsite configuration from a wellhead through to a flare or alternatively to a blooie line, a dotted line indicates recycling of drilling mud to the wellbore in the case of a mud drilling operation.

With reference to FIG. 1, a conventional drilling system comprises a drilling rig 10, a wellhead 11, wellbore 12 and a flare 13. Drilling fluids 14 are injected into the wellbore 12 to aid in extraction of cuttings 15 with the drilling fluids 14 from the wellbore 12. Suitable drilling fluids 14 include air, mist, foam or aerated mud or non-compressible liquid drilling fluids. The cuttings 15 are separated 16 from the drilling fluids 14 at surface 17. In the case where aerated mud or non-compressible mud is, the drilling fluid 14 is typically re-circulated to the wellbore 12, following separation 16 of the cuttings 15. In air, mist or foam drilling, air is used to extract cuttings from the wellbore 12, in place of drilling mud. The cuttings 15 may be lifted as dust or mist should there be an influx of water into the wellbore 12. Further, agents may be added to the wellbore 12 during drilling to create a foam to aid in lifting the cuttings 15. Drilling fluids 14 returning to surface 17 often include wellbore gases G including combustible hydrocarbons or off-gas which is burned at the flare 13 or alternatively, directly from a blooie line 18, which is typically used to discharge returned drilling fluids 14 to a flare pit 19. The rate of production of off-gases is highly unpredictable and typically intermittent.

Figure 2:
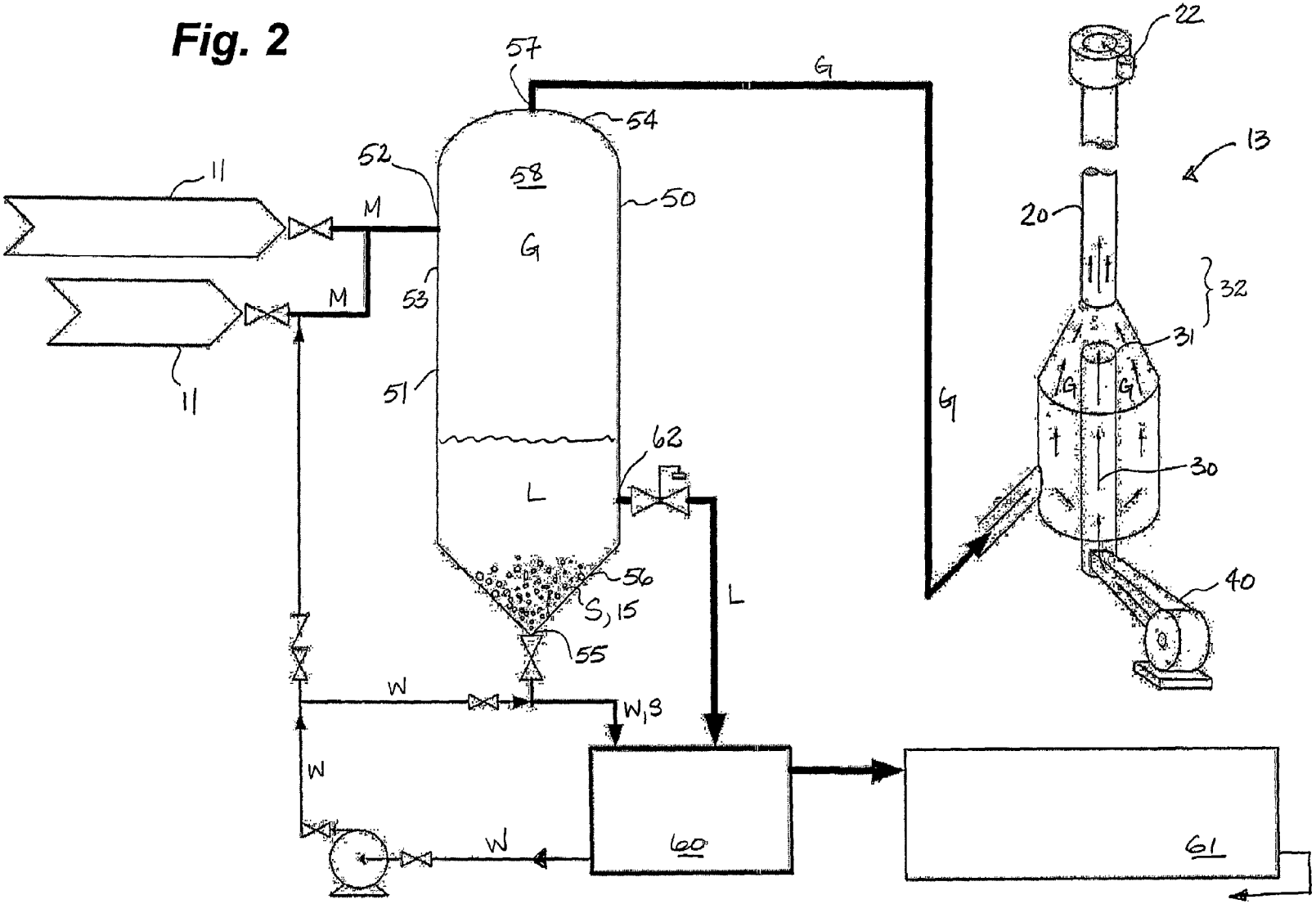
FIG. 2 is a schematic illustrating an embodiment of the invention being a system for drilling fluid handling used in a drilling application and incorporating a separator according to an embodiment of the invention, the particular embodiment illustrated being an air drilling operation using air, mist or foam as a drilling fluid, the system however being applicable to all mud drilling systems.
Figure 3:
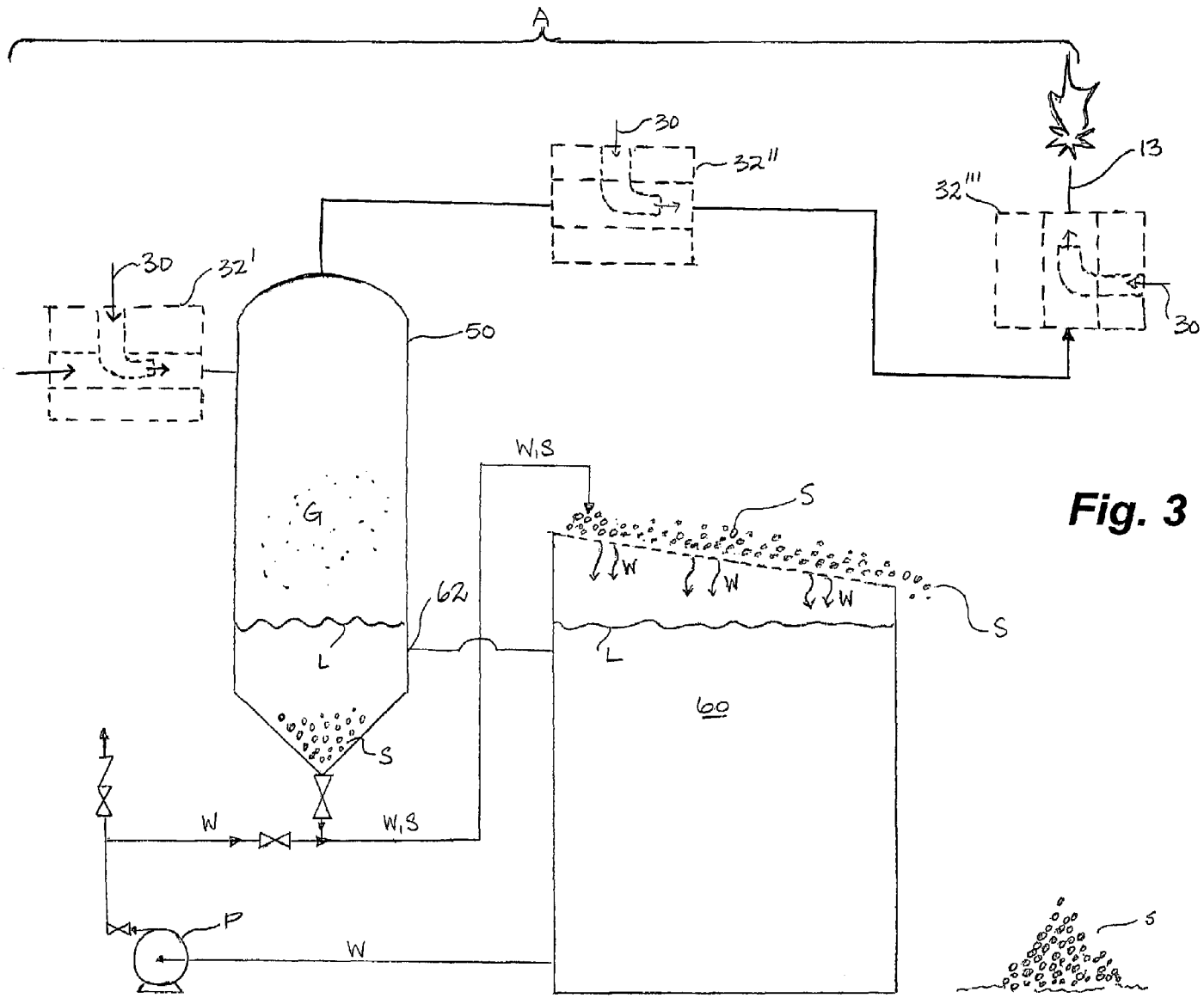
FIG. 3 is a schematic illustrating recirculating of fluid from a shale shaker tank past a solids outlet at a bottom of a separator for moving solids from the separator to the shale shaker according to an embodiment of the invention.

Having reference to FIGS. 2 and 3, a three-phase separator 50 for separating gases from liquids and cuttings produced from the wellbore 12 is provided. The separator 50 is typically positioned between the wellhead 11 and the flare stack 20 and, in conventional air drilling operations, is at risk for structural damage as a result of explosions caused by backflash from the flare 20.

More particularly, and in a preferred embodiment of the invention, the separator 50 for use in the present system is configured as a vertical separator, adapted for use in mud drilling systems and aerated mud systems, as well as air, mist and foam drilling systems. The separator 50 comprises a tubular, closed body 51 having an inlet 52 formed in a sidewall 53 of the separator 50 adjacent a top end 54 of the separator 50 for receiving a stream of fluids M comprising gases G, liquids L and cuttings 15 from the wellbore 12. A solids outlet 55 is formed at a bottom 56 for directing solids S, particularly cuttings 15, out of the separator 50 and a gas outlet 57 is formed at the top 54 of the separator 50 for discharging wellbore off-gases G.

Preferably, the bottom 56 is conical and angled at 33° or steeper to ensure that solids S, which are gravity separated from liquids L and gases G therein, do not become trapped in the separator's bottom 56 and are instead directed for discharge from the solids outlet 55.

Gases G, released from the liquids L and solids S, are contained within a headspace 58 above the liquids L in the separator 50 and are directed from the gas outlet 57 to the flare stack 20. The gases G flow at substantially atmospheric pressure to the flare stack 20. Accordingly, the separator 50 is at substantially atmospheric pressure.

More preferably, the wellhead 11 incorporates a choke (not shown) situated between the wellhead 11 and the separator 50. The choke acts to permit higher backpressure being placed on the wellbore without applying the same high backpressure to the separator 50. Thus, the separator 50 continues to evolve gases it would not, if it were placed under said high pressure conditions.

A flame arrestor 1, positioned at the flare 20 or between the separator 50 and the flare 20 acts to assist in preventing backflash to the low pressure separator 50.

As shown in FIG. 2 and, in greater detail, in FIG. 3, largely dewatered solids S, separated from the returned drilling fluids 14 and discharged from the solids outlet 55 at the bottom 56 of the separator 50 are directed to a shale shaker 60 where the solids S can be readily sampled. A level of liquid L in the separator 50 is hydraulically kept constant with a liquid level L in the shale shaker tank 60 resulting in a stagnant sump and causing the solids S to drop from the bottom 56 of the separator 50. Due to the significant volume of liquid L relative to the solids S in the conical portion of the separator 50, the residence time within the separator 50 is relatively long, maximizing any gas G evolution therefrom and into the head space 58. Further, the liquid L forms a liquid barrier preventing gas from venting to the shale shaker tank 60.

Preferably, as shown in FIG. 3, to aid in the discharge of solids S from the solids outlet 55, screened fluids W are re-circulated by pump P, from the shale shaker tank 60 or alternately from a mud tank or spare tank 61, and past the solids outlet 55 where the fluids W combine with the solids S to carry the solids S onto the shale shaker 60. The fluids W from the shaker are largely solids free and are continuously re-circulated by the pump P. As there is little remaining solid S in the fluid W following screening on the shale shaker 60, it is not required that the pump P be a solids pump.

A large portion of the liquids L separated in the separator 50 are routed to the shale shaker 60 from a liquid outlet 62 positioned in the sidewall 53 of the separator 50.

In an example, a liquid level volume in the separator 50 is approximately 8-9 $m^3$. Screened fluids W are pumped past the solids outlet 55 for a re-circulation rate of about 1.0 to 1.5 $m^3$ per minute. The art of pumping of screened fluids W is largely based on wellbore diameter, ROP and diameter of the tubing string and is typically calculated to maintain a ratio of cuttings/solids to liquid of about 25%.

Advantageously, the vertical separator 50 has a smaller footprint than conventional horizontal separators used in underbalanced drilling and thus requires less space at the wellsite. The system reduces the number of personnel required to operate the site. Depending upon the intended use requirements and reservoir conditions, the separator 50 may or may not be pressure rated.

Figure 4:
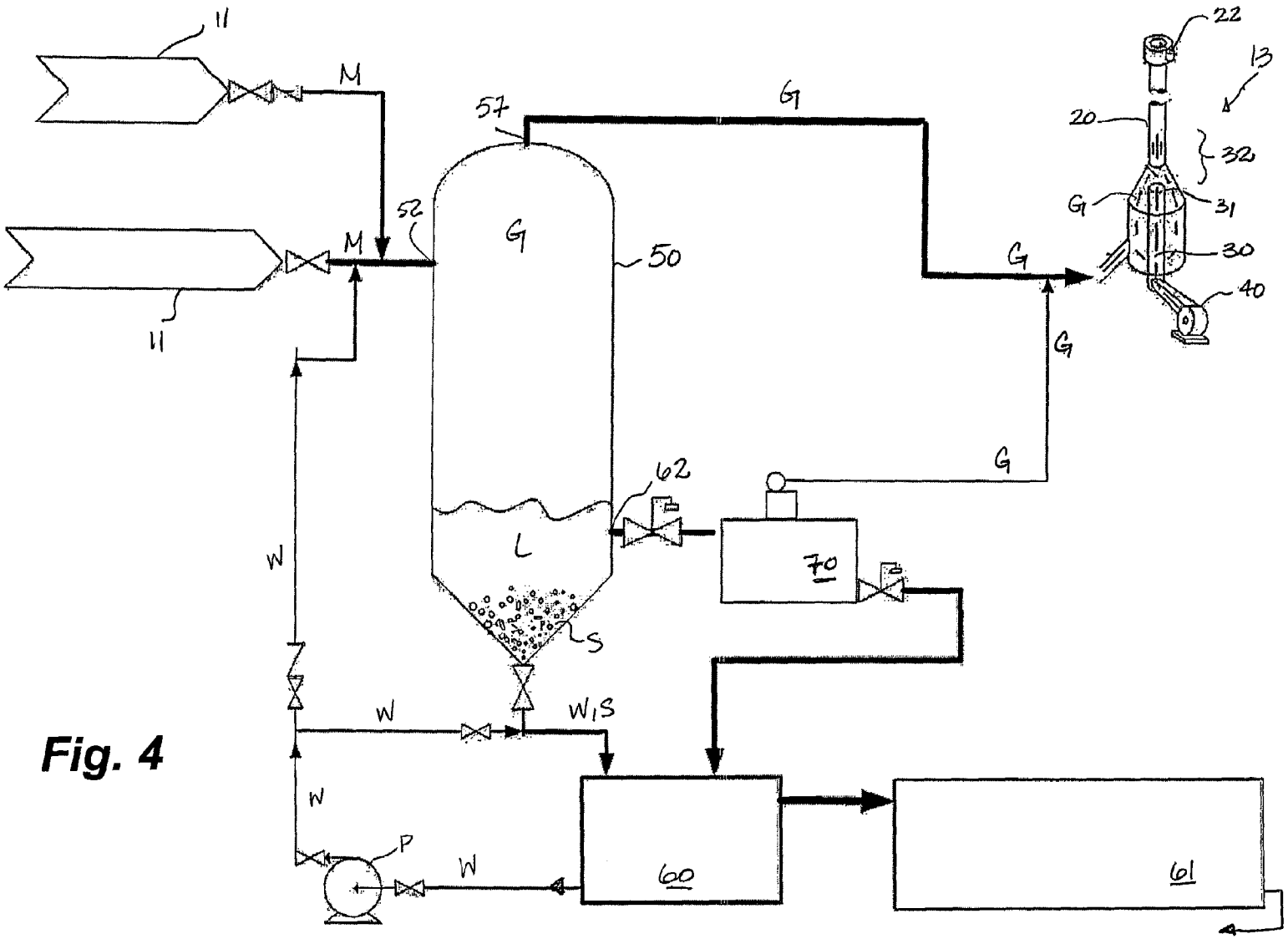
FIG. 4 is a schematic illustrating an embodiment of the invention having a vacuum degasser and being particularly applicable for drilling operations wherein the off-gas from the wellbore may contain at least a portion being sour gas.

As shown in an embodiment in FIG. 4, and for more complete degassing especially for use where the off-gases G produced from the wellbore 12 may contain at least some $H_2S$ or sour gases, a vacuum degasser 70 is connected to the system at the liquid outlet 62 for increased removal of off-gases G from the drilling fluids 14. Liquid L transported via the liquid outlet 62 to the vacuum degasser 70 are largely solids-free to avoid plugging of the vacuum degasser 70. Gas G entrained within the liquid L is removed by the vacuum degasser 70 by differential gas liberation in accordance with conventional technology. The separated gas G is then routed to the flare stack 20 for flaring.

The embodiments of the invention in which an exclusive property or privilege is claimed are defined as follows:

1. A system for handling drilling fluids including drilling cuttings returned from a wellbore during drilling, the fluids further comprising an intermittent and unpredictable flow of gaseous hydrocarbons entrained therein, the system comprising:

a vertical separator for receiving drilling fluids from the wellbore further comprising:

a liquid volume having a liquid level control, a stagnant zone of liquid for separating the entrained gaseous hydrocarbons from the drilling fluids;

a gas outlet for discharging evolved gaseous hydrocarbons at substantially atmospheric pressure therefrom;

a liquid outlet for discharging substantially gas free liquids therefrom, a solids outlet for gravity discharging substantially gas free drilling solids therefrom, and a shale shaker for receiving substantially gas free drilling solids and substantially gas free liquids discharged from the separator and for further separating the drilling solids from the liquids; and a recirculation line for flowing substantially gas free separated liquids from the shale shaker past the solids outlet of the separator wherein the substantially gas free drilling solids discharging from the solids outlet join the substantially gas free liquids for circulation to the shale shaker.

2. The system as described in claim 1 wherein the vertical separator further comprises:

a tubular closed body forming the liquid volume for separating the drilling fluids therein;

a fluids inlet formed in the tubular body adjacent a top end for receiving the drilling fluids from the wellbore; and a conical bottom end directed to the solids outlet.

3. The system as described in claim 2 wherein the liquid level control is the positioning of the liquid outlet in the tubular body so as to maintain a liquid level substantially at a liquid level of the shale shaker.

4. The system as described in claim 2 wherein the conical bottom is angled at about 33 degrees or steeper for directing solids to the solids outlet.

5. The system as described in claim 1 wherein the drilling is selected from the group consisting of air drilling, mist drilling, foam drilling, non-compressible fluid drilling, aerated mud drilling or mud drilling.

6. The system as described in claim 1 wherein the drilling is balanced.

7. The system as described in claim 1 wherein the drilling is underbalanced.

8. The system as described in claim 1 further comprising:

an ignition source for receiving and combusting evolved hydrocarbons from the separator; and a flame arrestor positioned between the wellbore and the ignition source.

9. The system as described in claim 8 wherein the flame arrestor further comprises:

a source of addition fluid connected to the flow of combustible hydrocarbons between the wellbore and the ignition source;

a venturi for accelerating the flow of combustible gas with the addition fluid for inducing flow of combustible gas to the ignition source; and wherein the addition fluid is continuously provided to the flow of combustible hydrocarbons in a velocity in excess of a minimal flame propagation velocity to prevent backflash from the ignition source to the wellbore.

10. The system as described in claim 8 wherein the flame arrestor is positioned between the separator and the ignition source.

11. The system as described in claim 8 wherein the ignition source is a flare stack.

12. The system as described in claim 8 wherein the vertical separator further comprises:

a tubular closed body forming the liquid volume for separating the drilling fluids therein;

a fluids inlet formed in the tubular body adjacent a top end for receiving the drilling fluids from the wellbore; and a conical bottom end directed to the solids outlet.

13. The system as described in claim 12 wherein the liquid level control is the positioning of the liquid outlet in the tubular body so as to maintain a liquid level substantially at a liquid level of the shale shaker.

14. The system as described in claim 12 wherein the conical bottom is angled at about 33 degrees or steeper for directing solids to the solids outlet.

15. The system as described in claim 8 wherein the drilling is selected from the group consisting of air drilling, mist drilling, foam drilling, non-compressible fluid drilling, aerated mud drilling or mud drilling.

16. The system as described in claim 8 wherein the drilling is balanced.

17. The system as described in claim 8 wherein the drilling is underbalanced.

* * * * *